US011073858B2

(12) United States Patent
Cheng

(10) Patent No.: US 11,073,858 B2
(45) Date of Patent: Jul. 27, 2021

(54) POWER SUPPLY SYSTEM AND METHOD

(71) Applicant: Sitronix Technology Corp., Hsinchu County (TW)

(72) Inventor: Chia-Chi Cheng, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 561 days.

(21) Appl. No.: 15/256,639

(22) Filed: Sep. 5, 2016

(65) Prior Publication Data

US 2017/0168517 A1 Jun. 15, 2017

Related U.S. Application Data

(60) Provisional application No. 62/265,969, filed on Dec. 10, 2015.

(51) Int. Cl.
*G05F 1/66* (2006.01)

(52) U.S. Cl.
CPC ..... *G05F 1/66* (2013.01)

(58) Field of Classification Search
CPC ..... G05F 1/66; G09G 3/36; H02J 9/00
USPC ..... 307/57, 130, 64, 115, 126; 345/78, 99, 345/212, 213; 323/282, 283, 299
See application file for complete search history.

(56) References Cited

U.S. PATENT DOCUMENTS

2001/0017489 A1* 8/2001 Inoue ..... G05F 3/222 307/130
2011/0149185 A1 6/2011 Yamazaki
2013/0235170 A1 9/2013 Huang
2014/0008984 A1* 1/2014 Kamiyama ..... H02J 9/06 307/64
2016/0189624 A1* 6/2016 Jang ..... G09G 3/3696 345/213
2016/0293106 A1* 10/2016 Seo ..... G09G 3/20
2018/0253178 A1* 9/2018 Ueyama ..... G02F 1/13338

FOREIGN PATENT DOCUMENTS

CN 104319870 A 1/2015
JP 2008257086 10/2008
JP 2016-73186 A 5/2016
KR 1020130030827 3/2013
TW 201230860 A1 7/2012
WO 2016/063487 A1 4/2016

* cited by examiner

*Primary Examiner* — Toan T Vu
(74) *Attorney, Agent, or Firm* — Winston Hsu

(57) ABSTRACT

A power supply system for a circuit device includes a power supply unit, a switch unit and a voltage detector. The power supply unit, coupled to the circuit device via a power line, is used for supplying basic power for the circuit device via the power line, wherein the power line is coupled to the circuit device via a plurality of nodes. The switch unit, near to a node among the plurality of nodes, is coupled to the circuit device via the power line. The voltage detector, coupled to the circuit device and the switch unit, is used for detecting a voltage of the node and controlling the switch unit to be closed to allow the circuit device to receive auxiliary power via the switch unit when detecting that the voltage of the node is lower than a first threshold value.

10 Claims, 6 Drawing Sheets

POWER SUPPLY SYSTEM AND METHOD

CROSS REFERENCE TO RELATED APPLICATIONS

This application claims the benefit of U.S. Provisional Application No. 62/265,969, filed on Dec. 10, 2015, the contents of which are incorporated herein by reference.

BACKGROUND OF THE INVENTION

1. Field of the Invention

The present invention relates to a power supply system and method, and more particularly, to a power supply system and method used for a circuit device.

2. Description of the Prior Art

A liquid crystal display (LCD) is a flat panel display which has advantages of low radiation, light weight and low power consumption and is widely used in various information technology (IT) products, such as laptops or flat panel televisions. An active matrix thin film transistor (TFT) LCD is the most commonly used transistor type in LCD families, and particularly in the large-size LCD family. A driving system installed in the LCD includes a timing controller, source drivers and gate drivers. The source and gate drivers respectively control data lines and scan lines, which intersect to form a cell matrix. Each intersection is a cell including crystal display molecules and a TFT. In the driving system, the gate drivers are responsible for transmitting scan signals to gates of the TFTs to turn on the TFTs on the panel. The source drivers are responsible for converting digital image data, sent by the timing controller, into analog voltage signals and outputting the voltage signals to sources of the TFTs. When a TFT receives the voltage signals, a corresponding liquid crystal molecule has a terminal whose voltage changes to equalize the drain voltage of the TFT, which thereby changes its own twist angle. The rate that light penetrates the liquid crystal molecule is changed accordingly, allowing different colors to be displayed on the panel.

As technology advances, the resolution of the LCD increases with increasing size. When the size of LCD becomes larger, the number of the driving units in the driver for driving the screen (e.g., amplifiers or buffers for driving data lines in the source driver) may increase, where the driving units are always laid in a line for driving their corresponding data line or scan line, respectively, and the length of layout depends on the screen size. The power supply device for supplying power is usually disposed in an area and power is supplied to the driving units in the driver via power lines. However, when the number of driving units in the driver increases and/or the length of layout increases, the length of power line may increase as well. The impedance on the power line generates a significant voltage drop, which influences the driving capability and response speed of the driving units located in far ends. Therefore, the voltage operating range of the driving units in the far ends of data line may be limited and a longer time is required to charge these driving units. Thus, there is a need to provide a power supply system and method, to improve the performance of the driving units in the far ends.

SUMMARY OF THE INVENTION

It is therefore an objective of the present invention to provide a power supply system and method, which are capable of turning on auxiliary power to be supplied when the voltage in the terminal of the power line is too low, in order to enhance the driving capability and response speed of the driving units in the terminal.

The present invention discloses a power supply system for a circuit device. The power supply system comprises a power supply unit, a switch unit and a voltage detector. The power supply unit, coupled to the circuit device via a power line, is used for supplying basic power for the circuit device via the power line, wherein the power line is coupled to the circuit device via a plurality of nodes. The switch unit, near to a node among the plurality of nodes, is coupled to the circuit device via the power line. The voltage detector, coupled to the circuit device and the switch unit, is used for detecting a voltage of the node and controlling the switch unit to be closed to allow the circuit device to receive auxiliary power via the switch unit when detecting that the voltage of the node is lower than a first threshold value.

The present invention further discloses a power supply method for a circuit device. The power supply method comprises supplying basic power for the circuit device via a power line, wherein the power line is coupled to the circuit device via a plurality of nodes; detecting a voltage of a node among the plurality of nodes; and controlling a switch unit coupled to the circuit device to be closed to allow the circuit device to receive auxiliary power via the switch unit when detecting that the voltage of the node is lower than a threshold value.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
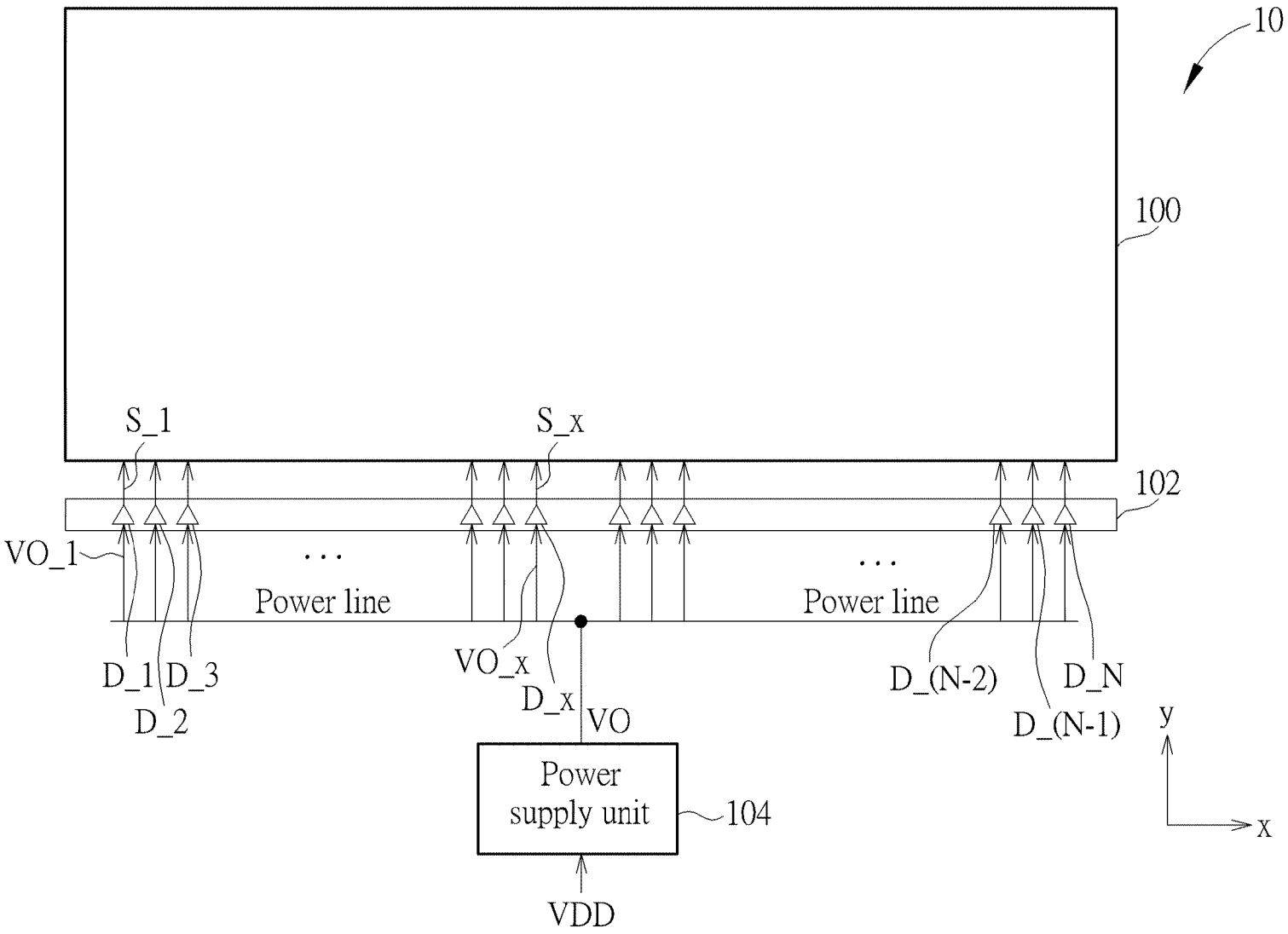
FIG. 1 is a schematic diagram of a liquid crystal display.

Please refer to FIG. 1, which is a schematic diagram of a liquid crystal display (LCD). As shown in FIG. 1, the LCD 10 includes a screen 100, a source driver 102 and a power supply unit 104. Other possible components or modules such as a gate driver and a timing controller may be included or not according to system requirements. These components are omitted herein without affecting the illustrations of the present embodiments. In the LCD 10, the source driver 102 includes driving units D_1-D_N, for driving data lines on the screen 100. Since the driving units D_1-D_N need to drive corresponding data lines, respectively, the driving units D_1-D_N should be disposed along x-direction in the circuit layout. In such a condition, the source driver 102 appears to be a narrow and long layout structure, where the length in x-direction is far greater than the height in y-direction. The power supply unit 104 is used to supply power for the source driver 102. In general, the power supply unit 104 may be disposed in or near the middle location in the bottom long side of the source driver 102 having the narrow and long layout, and a power line is allocated to connect all driving units D_1-D_N in the source driver 102, in order to output basic power VO to the driving units D_1-D_N via the power line. The power supply unit 104 may receive input power VDD from the system, and perform conversion or processing on the input power VDD to generate the basic power VO and then output the basic power VO. In order to stabilize the output power of the source driver 102, the power supply unit 104 may be a voltage regulator, e.g., a low dropout (LDO) regulator, for supplying stable basic power VO for the driving units D_1-D_N.

Figure 2A:
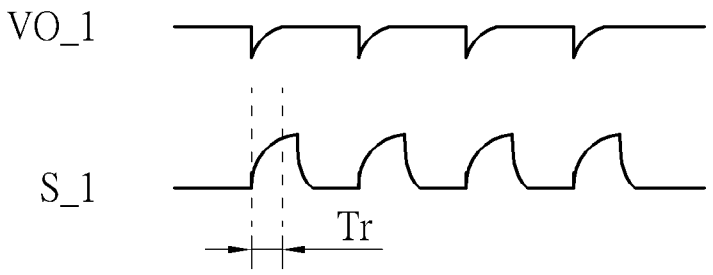
FIG. 2A is a waveform diagram of the power and display signals in the far end of the power line.
Figure 2B:
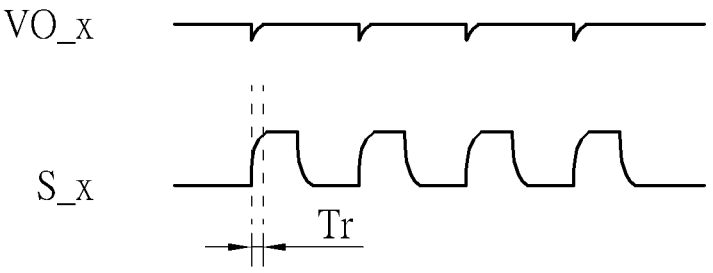
FIG. 2B is a waveform diagram of the power and display signals in the near end of the power line.

Please note that the source driver 102 is extended along x-direction with the narrow and long layout structure; hence, the arrangement of power line should extend along x-direction. With the increasing resolution and size of the LCD, the number of driving units required in the source driver may increase. Therefore, the layout structure of the source driver may also become longer, and the length of the power line also increases. In such a condition, with the internal impedance existing in the power line, a larger IR drop may appear in the far ends of the power line when the current becomes larger. This affects the driving capability of the driving units in the far ends. For example, in the source driver 102, the driving unit D_1 located in the far end has a longer distance with the power supply unit 104; hence, the basic power VO should undergo larger impedance on the power line to become power VO_1 received by the driving unit D_1, where the magnitude of impedance may reach 20 ohms. When the driving unit D_1 outputs a display signal S_1, the display signal S_1 may instantly draw a great amount of current. This instant current incorporated with the impedance on the power line generates the IR drop, which lets the voltage of the power VO_1 to fall instantly and fail to return quickly. Therefore, the rising speed of the display signal S_1 may decrease (the display signal S_1 has a longer rising time (Tr)), and the voltage operating range realized by the display signal S_1 may also be limited, as shown in FIG. 2A. In contrast, the driving unit D_x near to the power supply unit 104 receives power VO_x from the power supply unit 104. When the driving unit D_x outputs its corresponding display signal S_x, the power VO_x falls with a smaller degree and returns rapidly since the power VO_x undergoes less impedance. In such a condition, the display signal S_x has a faster response speed (the rises time (Tr) is smaller), and is able to realize a larger voltage operating range, as shown in FIG. 2B.

Figure 3:
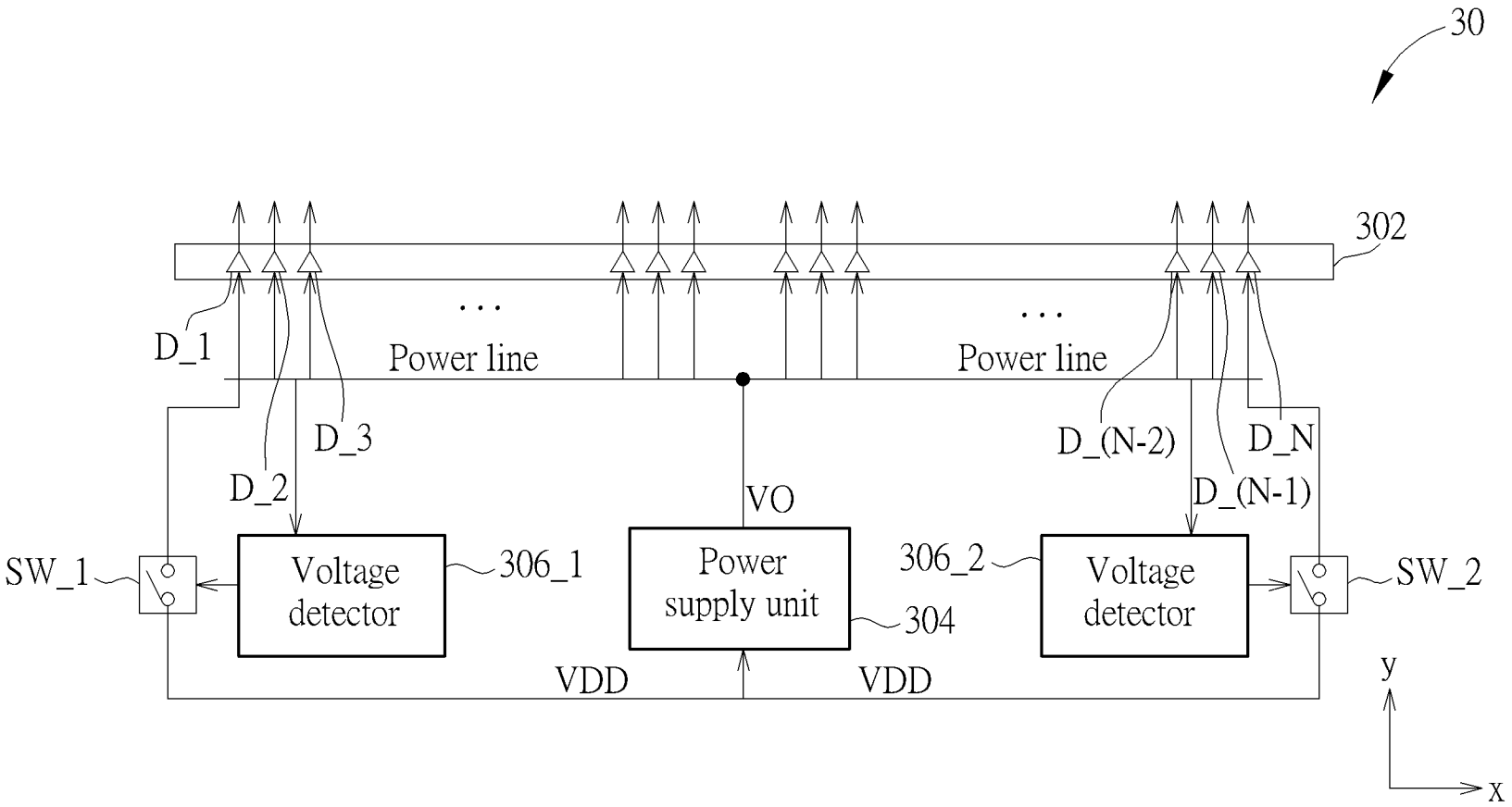
FIG. 3 is a schematic diagram of a power supply system according to an embodiment of the present invention.

In order to prevent the parasitic impedance of the power line from decreasing the driving capability of the driving units in the far end, the present invention may dispose a switch in the terminals of the power line, where the switch is coupled to a supply terminal of auxiliary power. When the voltage in a terminal of the power line is too low, the switch is closed to supply charge currents via the auxiliary power. Please refer to FIG. 3, which is a schematic diagram of a power supply system 30 according to an embodiment of the present invention. As shown in FIG. 3, the power supply system 30 includes a circuit device 302, a power supply unit 304, switch units SW_1 and SW_2 and voltage detectors 306_1 and 306_2. The circuit device 302, which has a structure similar to the source driver 102 shown in FIG. 1, may be a source driver used for an LCD. In another embodiment, the circuit device 302 may be another type of circuit for implementing specific functions, and is not limited herein. The power supply unit 304 may supply the basic power VO for the circuit device 302. The power supply unit 304 is coupled to the circuit device 302 via the power line, to supply the basic power VO for the circuit device 302 via the power line, where the power line is coupled to the circuit device 302 via a plurality of nodes. For example, if the circuit device 302 is a source driver, the power line may be coupled to the source driver via a plurality of nodes, where each node is connected to a driving unit in the source driver.

In the following embodiments, the circuit device 302 is described as the source driver 302 for illustration convenience. Those skilled in the art should realize that the implementation of the circuit device 302 is not limited herein.

As mentioned above, the driving units in the source driver 302 should be disposed along x-direction to allow the driving units to drive their corresponding data lines; hence, the source driver 302 has a narrow and long layout structure, and its length in x-direction is far greater than height in y-direction. Therefore, there is larger impedance in the power line between a driving unit located in the far end (e.g., the driving unit D_1, D_2, D_(N-1) or D_N) and the power supply unit 304. In such a situation, the switch units SW_1 and SW_2 may be disposed in the left side terminal and right side terminal of the source driver 302, respectively, e.g., the locations near to the coupling nodes of the driving units D_1 and D_N. One terminal of the switch units SW_1 and SW_2 is coupled to the source driver 302 via the power line. Another terminal of the switch units SW_1 and SW_2 is coupled to an input terminal of the power supply unit 304. In this embodiment, input power VDD of the power supply unit 304 may be used as the auxiliary power, which is incorporated when the terminal voltage of the power line is too low, in order to make the terminal voltage return rapidly. The voltage detectors 306_1 and 306_2 are disposed in the left-hand side and right-hand side of the source driver 302, respectively, for controlling the operations of the switch units SW_1 and SW_2. In detail, the voltage detector 306_1 may detect the voltage of the left side terminal of the power line, e.g., the voltage in the node coupled to the driving unit D_1 or D_2. When detecting that the terminal voltage is lower than a first threshold value, the voltage detector 306_1 may control the switch unit SW_1 to be closed, allowing the source driver 302 to receive the auxiliary power (i.e., the power VDD) via the switch unit SW_1. Similarly, the voltage detector 306_2 may detect the voltage of the right terminal of the power line, e.g., the voltage in the node coupled to the driving unit D_(N-1) or D_N. When detecting that the terminal voltage is lower than the first threshold value, the voltage detector 306_2 may control the switch unit SW_2 to be closed, allowing the source driver 302 to receive the auxiliary power (i.e., the power VDD) via the switch unit SW_2.

Please note that, the switch units SW_1 and SW_2 are closed when the terminal voltage of the power line is too low, so that the auxiliary power may be applied to raise the terminal voltage. However, the voltage value supplied to operate the driving units D_1-D_N (i.e., the voltage value of the power line) is determined by the power supply unit 304, and the auxiliary power may be applied only when the terminal voltage is too low. When the terminal voltage returns to an enough value, the switch units SW_1 and SW_2 may become open. In an embodiment, the voltage detectors 306_1 and 306_2 may keep detecting the terminal voltage of the power line when the switch units SW_1 and SW_2 are closed. When the terminal voltage returns to be greater than a second threshold value, the voltage detector 306_1 or 306_2 may control the switch unit SW_1 or SW_2 to be open, where the power supply unit 304 controls the voltage value, allowing the source driver 302 to receive a stable voltage. Preferably, the voltage of the auxiliary power should be greater than or equal to the voltage of the basic power VO, so that the terminal voltage of the power line may rise rapidly. The magnitude of the second threshold value may be the same as the magnitude of the first threshold value. Alternatively, in order to prevent the terminal voltage of the power line from oscillating around the threshold value, the magnitude of the second threshold value may be configured to be slightly higher than the magnitude of the first threshold value in a hysteresis manner.

Figure 4:
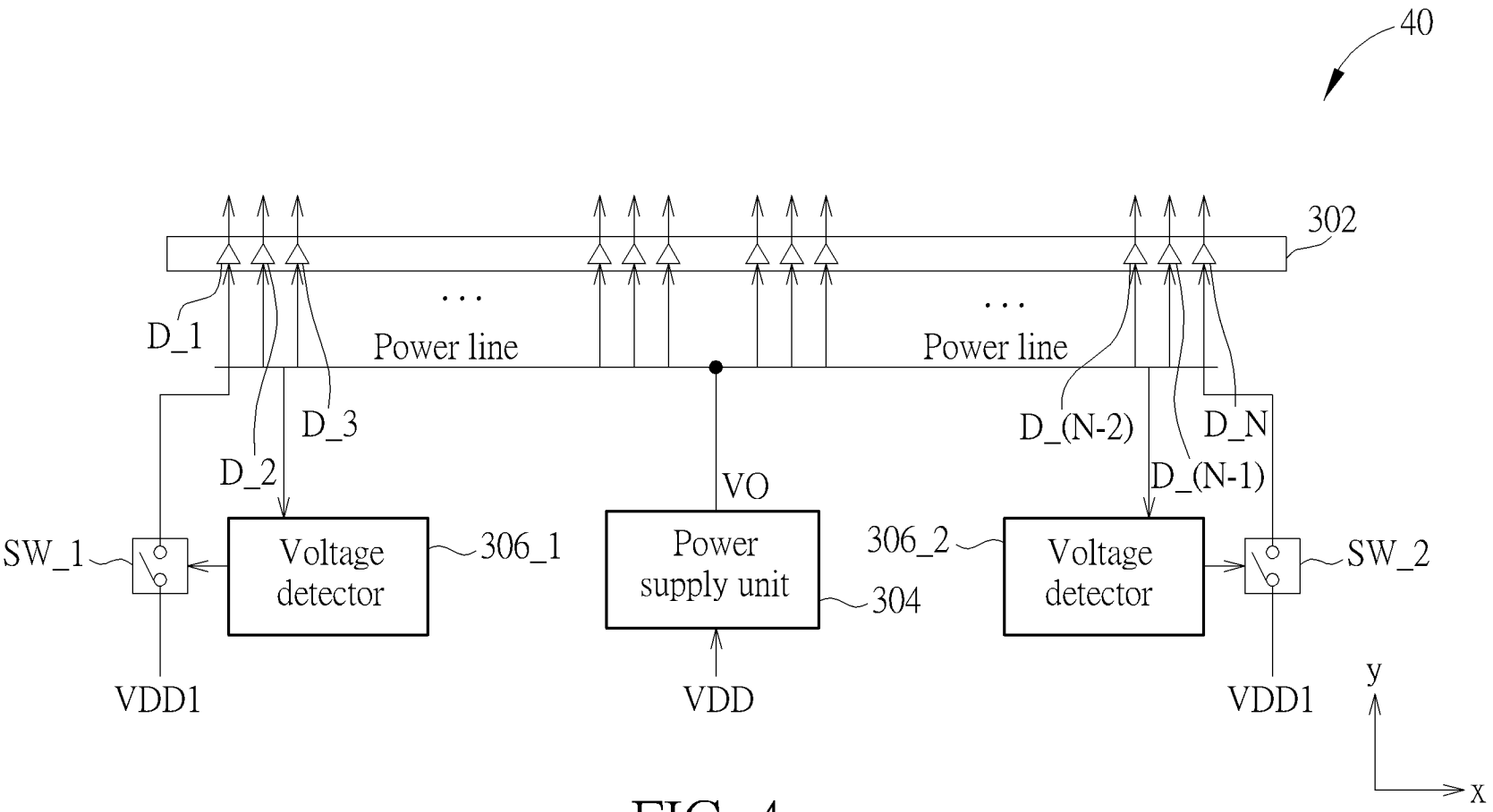
FIG. 4 is a schematic diagram of another power supply system according to an embodiment of the present invention.

In another embodiment, the source of the auxiliary power may not be limited to the input power VDD of the power supply unit 304. Please refer to FIG. 4, which is a schematic diagram of another power supply system 40 according to an embodiment of the present invention. As shown in FIG. 4, the circuit structure of the power supply system 40 is similar to the circuit structure of the power supply system 30, so signals and elements having similar functions are denoted by the same symbols. The main difference of the power supply system 40 and the power supply system 30 is that, in the power supply system 30, the power VDD is used as the input power of the power supply unit 304 and also used as the auxiliary power for raising the terminal voltage of the power line; while in the power supply system 40, the input power VDD of the power supply unit 304 is different from the auxiliary power VDD1. This auxiliary power VDD1 may come from any power supply circuit in the chip or an external voltage source outside the chip. As long as the auxiliary power VDD1 has enough voltage value (i.e., greater than or equal to the basic power VO), it may be used to raise the terminal voltage of the power line when the terminal voltage is too low.

In another embodiment, the screen is required to be driven by a higher voltage. Therefore, the source driver should output a higher voltage to the data lines on the screen. In this embodiment, each driving unit is coupled to a voltage control unit, which is used for controlling the output voltage of the driving unit. Preferably, the voltage control unit may be a charge pump, for generating the higher output voltage.

Figure 5:
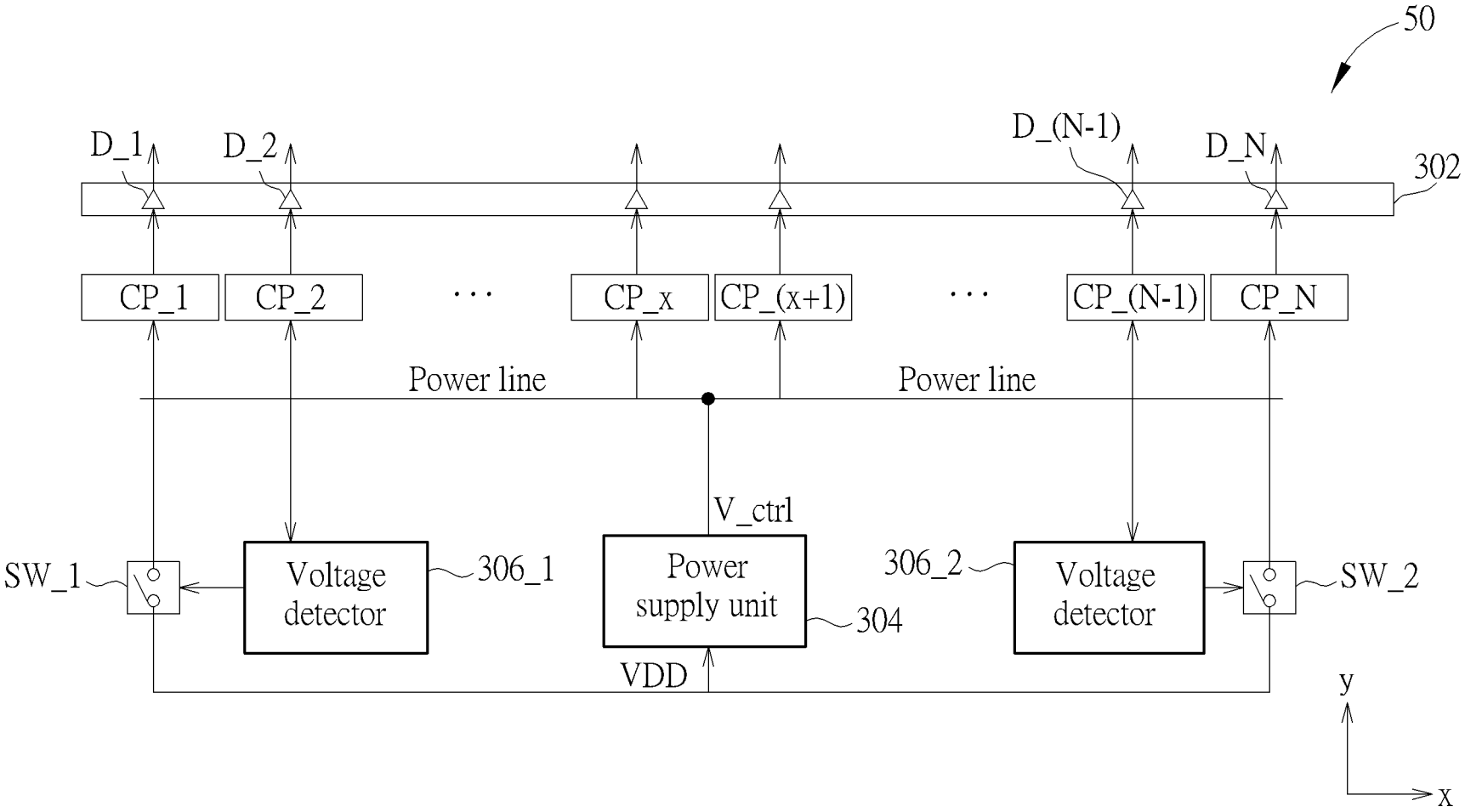
FIG. 5 is a schematic diagram of a further power supply system according to an embodiment of the present invention.

Please refer to FIG. 5, which is a schematic diagram of a further power supply system 50 according to an embodiment of the present invention. As shown in FIG. 5, the circuit structure of the power supply system 50 is similar to the circuit structure of the power supply system 30, so signals and elements having similar functions are denoted by the same symbols. The main difference of the power supply system 50 and the power supply system 30 is that, in the power supply system 50, charge pumps CP_1-CP_N are disposed in the front end of the driving units D_1-D_N, respectively. The power supply unit 304 is connected to the charge pumps CP_1-CP_N via the power line, and the charge pumps CP_1-CP_N are connected to the source driver 302. In this embodiment, the power supply unit 304 may output a control voltage V_ctrl, for controlling the operations of the charge pumps CP_1-CP_N. Similarly, the voltage detectors 306_1 and 306_2 may detect the output voltage of any of the charge pumps CP_1-CP_N. For example, the voltage detector 306_1 may detect the output voltage of the charge pump CP_1 or CP_2 in the leftmost side, and the voltage detector 306_2 may detect the output voltage of the charge pump CP_N or CP_(N-1) in the rightmost side. When determining that the output voltage is lower that a threshold value, the voltage detector 306_1 or 306_2 may control the switch unit SW_1 or SW_2 to be closed, allowing the charge pumps CP_1-CP_N to receive the auxiliary power via the switch unit SW_1 or SW_2.

By using the auxiliary power of the present invention, the voltage of power supply in the terminals of the power line may not significantly decrease and may return easily under the triggers of the display signals. In addition, the auxiliary power mitigates the loading of the power supply unit, which benefits the stability of the basic power, so that the driving capability of the driving units located in the near terminal of the power line (such as the driving unit D_x) may also be increased. In such a condition, the performance of the source driver may be improved entirely, which increases the voltage operating range of the display signal and reduces the charging time.

Please note that the above embodiments are only used for illustrating several implementations of the present invention. Those skilled in the art can make modifications and alternations accordingly. For example, in the above embodiments, only one switch unit and voltage detector is disposed in each of the left-hand side and right-hand side of the source driver, but in another embodiment, there may be multiple switch units and voltage detectors uniformly allocated along x-direction, to be adapted to higher driving unit numbers or longer layout of the power line. In addition to the LDO regulator, the power supply unit may be other type of regulator circuit, such as a buck converter, boost converter, or any other type of power supply device.

Figure 6:
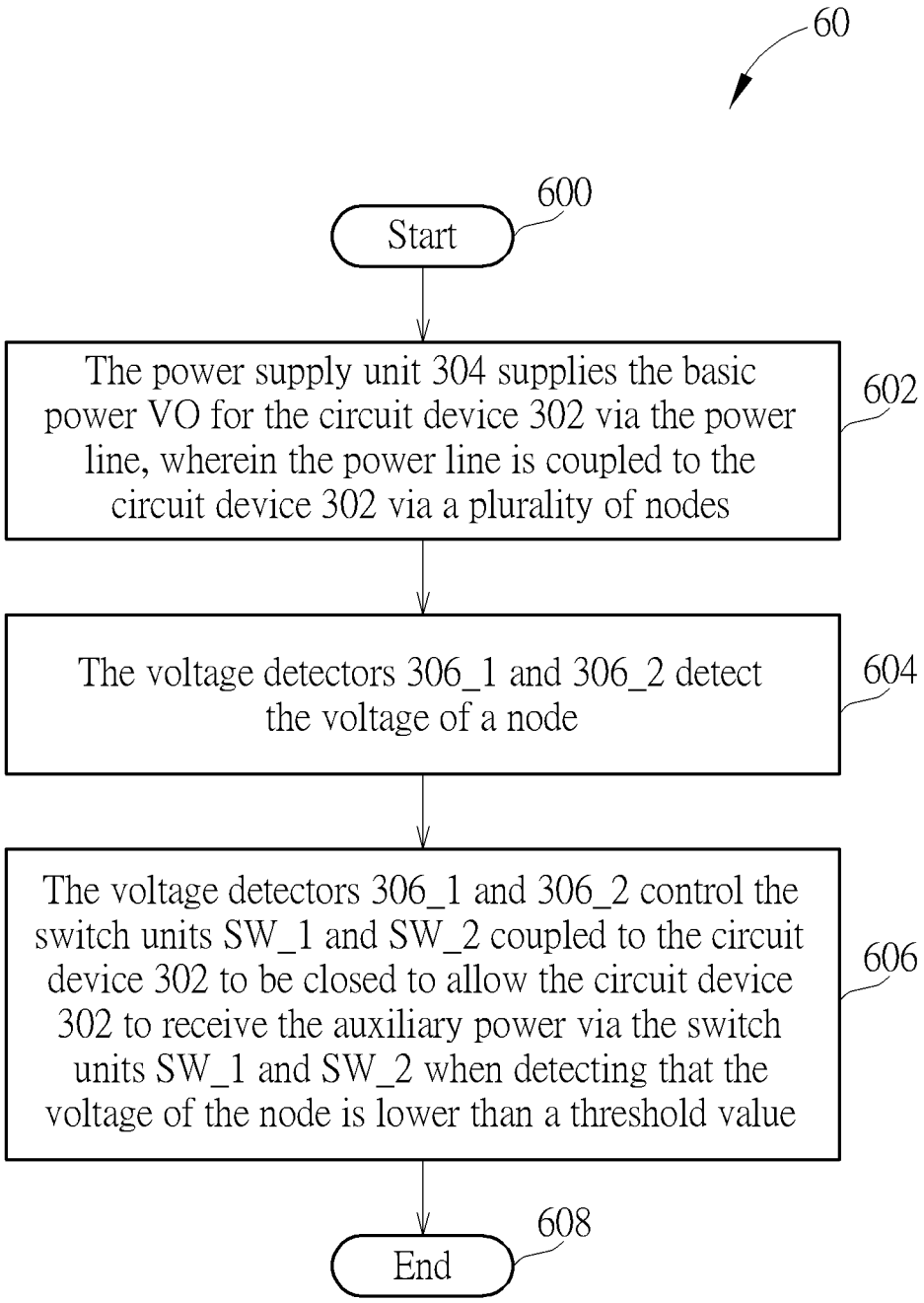
FIG. 6 is a schematic diagram of a power supply process according to an embodiment of the present invention.

The abovementioned power supply method used for the power supply systems 30, 40 and 50 may be summarized into a power supply process 60, as shown in FIG. 6. The power supply process 60 includes the following steps:

Step 600: Start.

Step 602: The power supply unit 304 supplies the basic power VO for the circuit device 302 via the power line, wherein the power line is coupled to the circuit device 302 via a plurality of nodes.

Step 604: The voltage detectors 306_1 and 306_2 detect the voltage of a node.

Step 606: The voltage detectors 306_1 and 306_2 control the switch units SW_1 and SW_2 coupled to the circuit device 302 to be closed to allow the circuit device 302 to receive the auxiliary power via the switch units SW_1 and SW_2 when detecting that the voltage of the node is lower than a threshold value.

Step 608: End.

The detailed operations and alternations of the power supply process 60 are described in the above paragraphs, and will not be narrated herein.

To sum up, the present invention discloses a method operated in a source driver of an LCD and a related power supply system. Especially when the LCD has a large size and high resolution, the source driver is required to be disposed in a narrow and long layout structure. In the narrow and long layout structure, a switch unit and a voltage detector may be disposed on both sides of the source driver. The switch unit may be closed to supply power via auxiliary power when the terminal voltage of the power line is too low, in order to enhance the driving capability and response speed of the driving units in the far ends. In such a condition, the driving capability of the driving units in the source driver is improved, so as to increase the voltage operating range of the display signals and reduce the charging time.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A power supply system for a circuit device, comprising:

a power supply unit, coupled to the circuit device via a power line, for supplying basic power for the circuit device via the power line, wherein the power line is coupled to the circuit device via a plurality of nodes;

a switch unit, near to a node among the plurality of nodes, coupled to the circuit device via the power line; and a voltage detector, coupled to the circuit device and the switch unit, for detecting a voltage of the node and controlling the switch unit to be closed to allow the circuit device to receive auxiliary power via the switch unit when detecting that the voltage of the node is lower than a first threshold value;

wherein the circuit device has a narrow and long layout structure, wherein the power supply unit is near to a middle point of a long side of the circuit device and the switch unit is near to a terminal of the long side.

2. The power supply system of claim 1, wherein the auxiliary power is input power of the power supply unit.

3. The power supply system of claim 1, wherein the auxiliary power is an external voltage source difference from input power of the power supply unit.

4. The power supply system of claim 1, wherein the power line is connected to the circuit device or coupled to the circuit device via a plurality of voltage control units.

5. The power supply system of claim 4, wherein each of the plurality of voltage control units is a charge pump.

6. The power supply system of claim 1, wherein the voltage detector controls the switch unit to be open when the voltage detector detects that the voltage of the node is higher than a second threshold value.

7. The power supply system of claim 1, wherein a voltage of the auxiliary power is greater than or equal to a voltage of the basic power.

8. The power supply system of claim 1, wherein the circuit device is a source driver of a display device.

9. The power supply system of claim 1, wherein the power supply unit is a low dropout regulator.

10. A power supply method for a circuit device, comprising:

supplying basic power for the circuit device via a power line, wherein the power line is coupled to the circuit device via a plurality of nodes;

detecting a voltage of a node among the plurality of nodes; and controlling a switch unit coupled to the circuit device to be closed to allow the circuit device to receive auxiliary power via the switch unit when detecting that the voltage of the node is lower than a threshold value;

wherein the circuit device has a narrow and long layout structure, wherein a power supply unit for supplying the basic power is near to a middle point of a long side of the circuit device and the switch unit is near to a terminal of the long side.

* * * * *